US008387947B2

(12) United States Patent
Uemura et al.

(10) Patent No.: US 8,387,947 B2
(45) **Date of Patent: *Mar. 5, 2013**

(54) CAPACITY CONTROL VALVE

(75) Inventors: Norio Uemura, Tokyo (JP); Toshiaki Iwa, Tokyo (JP); Katsuya Shirai, Tokyo (JP); Keigo Shirafuji, Tokyo (JP)

(73) Assignee: Eagle Industry Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/253,717

(22) Filed: Oct. 5, 2011

(65) Prior Publication Data

US 2012/0037822 A1 Feb. 16, 2012

Related U.S. Application Data

(62) Division of application No. 12/615,893, filed on Nov. 10, 2009, now Pat. No. 8,128,061, which is a division of application No. 10/578,905, filed as application No. PCT/JP2004/016881 on Nov. 12, 2004, now abandoned.

(30) Foreign Application Priority Data

Nov. 14, 2003 (JP) ..... 2003-384718

(51) Int. Cl.
*F16K 31/02* (2006.01)

(52) U.S. Cl. ..... 251/129.19; 251/129.15; 251/129.07

(58) Field of Classification Search ..... 251/129.07, 251/129.15, 129.19; 417/222.2
See application file for complete search history.

(56) References Cited

U.S. PATENT DOCUMENTS

| | | | | |
|---|---|---|---|---|
| 4,538,645 | A | 9/1985 | Perach | |
| 4,606,705 | A | 8/1986 | Parekh | |
| 4,835,426 | A | 5/1989 | Henville | |
| 5,071,321 | A | 12/1991 | Skinner et al. | |
| 5,540,558 | A | 7/1996 | Harden et al. | |
| RE35,672 | E | 11/1997 | Taguchi | |
| 6,971,627 | B2 | 12/2005 | Hirata et al. | |
| 7,077,380 | B2 | 7/2006 | Uemura et al. | |
| 8,128,061 | B2 * | 3/2012 | Uemura et al. | 251/129.19 |

FOREIGN PATENT DOCUMENTS

| | | | |
|---|---|---|---|
| DE | 197 10 050 | A1 | 9/1998 |
| EP | 1 243 449 | A2 | 9/2002 |
| EP | 1 507 109 | A1 | 2/2005 |
| JP | 63 190579 | U | 12/1988 |
| JP | 02 151006 | A | 6/1990 |
| JP | 2001 342946 | A | 12/2001 |
| JP | 2003-278650 | A | 10/2003 |

* cited by examiner

*Primary Examiner* — John K Fristoe, Jr.
*Assistant Examiner* — Matthew W Jellett
(74) *Attorney, Agent, or Firm* — Arent Fox LLP

(57) ABSTRACT

A capacity control valve includes a solenoid portion; a tube placed in the solenoid portion; and a movable core which forms a slide surface that is fitted to the tube. An actuation rod has a joint portion and a valve body, the joint portion being engaged with an abutting surface of a solenoid rod portion, and the valve body opening or closing a control fluid passage. The joint surface of the solenoid rod portion or the abutting face of the actuation rod has a concave cone-shape surface while the other has a convex cone-shape portion. A bottom face of the concave cone-shape surface is formed as a wide area of either a planar surface or a circular cross section, wherein a head portion of the convex cone-shape portion is truncated to form a truncated cone surface, the truncated cone surface corresponding to the bottom face of the concave cone-shape surface.

3 Claims, 6 Drawing Sheets

CAPACITY CONTROL VALVE

CROSS-REFERENCE TO RELATED APPLICATION

This application is a Divisional of U.S. patent application Ser. No. 12/615,893 filed on Nov. 10, 2009, which is a Divisional of U.S. patent application Ser. No. 10/578,905 filed on May 12, 2006, which is a National Stage entry of International Application No. PCT/JP2004/016881 filed on Nov. 12, 2004, which claims priority to Japanese Patent Application No. 2003-384718 filed on Nov. 14, 2003. The disclosures of the prior applications are incorporated in their entirety by reference.

TECHNICAL FIELD

The present invention relates generally to a capacity control valve for variably modulating the flow rate or pressure of process fluid in a control chamber in accordance with an opening and closing action of a valve body that slidably moves with a movable iron core and a solenoid rod. More particularly, the invention relates to a capacity control valve in which an improvement is made on the slide friction of a solenoid rod and a movable iron core that are connected with a valve body.

BACKGROUND ART

There have been known as a relative art of the present invention capacity control valves for a variable displacement type compressor. In the displacement control valve, a valve body is mounted to an actuation rod and the valve body opens and closes its valve in accordance with the actuation of a solenoid rod in a solenoid portion. The solenoid rod is connected to a movable iron core that is retained in a bore placed in a mating fixed iron core in a freely slidable manner (for example, see FIG. 1 shown in Japanese Unexamined Patent Publication No. 2001-342946,A).

A displacement control valve in FIG. 6 has similarity to a displacement control valve disclosed in FIG. 1 of the patent reference 1. In FIG. 6, a valve housing 105 has an axially extending through hole therein. The through hole is composed of a discharge valve hole 110C, a suction valve hole 110D, a first guide hole 110E, and a second guide hole 110F. There is formed a valve chamber 111 between the discharge valve hole 110C and the suction valve hole 110D. A first suction pressure passage 110B1 is communicated with the suction valve hole 110D while a discharge pressure passage 110A is communicated with the discharge valve hole 110C. Also shown at the bottom portion of the figure is a second suction pressure passage 110B2 which is communicated with the through hole.

The valve housing 105 has an integral construction in which a first valve housing 105A and a second valve housing 105B are joined at their end portions via screw connection. The first valve housing 105A disposes a spring chamber 120 at its end portion. The open end of the spring chamber 120 is connected to a spring seat portion 122 thereat via screw connection. There is disposed a spring 121 between the spring seat portion 122 and an actuation rod 101. Fastening the thread on the spring seat portion 122 adjusts the spring force of the spring 121. The spring 121 thus yields a resilient urging force against the actuation rod 101 in an upward direction as the figure shows.

The actuation rod 101 is placed along the through hole of the valve housing 105. The actuation rod 101 has an integral construction which is comprised of a first stopper 101E sliding against the second guide hole 110F, a valve body 101A being disposed in the valve chamber 111, and a second guide hole 110F fitting the second stopper 101F in freely slidable a manner. The end face of a solenoid rod 101C which is fitted to a rod bore 132A of a fixed iron core 132 comes to a planar contact with the end face of the actuation rod 101. Also both end faces of the valve body 101A define valve faces thereat. Opening areas of the discharge valve hole 110C and the suction valve hole 110D are modulated in an alternate manner by abutting and lifting actions of the valve faces of the valve body 101A against the valve seats which are arranged in the valve chamber 111 of the valve housing 111. Actuation of the valve body 101A in a direction opening the discharge valve hole 110C induces a rigorous flow of fluid at discharge pressure from the discharge pressure passage 110A into a crank chamber pressure passage 110G. This action, at the same time, implies the valve body 101A to move in a direction closing the suction valve hole 110D, thus reducing the outflow of fluid at suction pressure from the suction pressure passage 110B1 to the crank chamber pressure passage 110G.

The actuation rod 101 which is integral to the valve body 101A permits the first stopper 101E and the second stopper 101F, respectively, to slide against the first guide hole 110E and the second guide hole 110F. The valve face of the valve body 101A also comes into contact with and lifts off the valve seat. Therefore, the sliding resistance of the valve body 101A as well as of the first stopper 101E and the second stopper 101F needs to be reduced in order to avoid friction and wear thereof.

The other end portion of the valve housing 105 defines a solenoid portion 130. The solenoid portion 130 is comprised of a movable iron core 131, a fixed iron core 132 and a solenoid coil 135. Exciting the solenoid coil 135 actuates the movable iron core 131, which in turn moves the solenoid rod 101C. The solenoid rod 101C then undergoes a sliding motion, being guided by the rod bore 132A of the fixed iron core 132. A portion of fluid at suction pressure Ps supplied from the suction pressure passage 110B1 is permitted to flow into a movable iron core chamber 136 after passing through the clearance formed at the outer circumference of the solenoid rod 101C. This creates a balance in force at both sides thereof by equalizing the pressures within the movable iron core chamber 136 and the spring chamber 120.

This displacement control valve 100 operates in such a manner that the valve body 101A alternately opens and closes the discharge valve hole 110C and suction valve hole 110D by the action of the actuation rod 101 which is determined by an actuation force in accordance with an electric current supplied to the solenoid portion 130 and a reaction force exerted by the spring 121. The reciprocating control of the opening degrees of the discharge valve hole 110C and suction valve hole 110D by the valve body 101A allows fluid at discharge pressure Pd and fluid at suction pressure Ps to modulate a swash plate after flowing into a crank chamber of a compressor (not shown).

In the actuation rod 101 of the displacement control valve 100, the first stopper 101E and the second stopper 101F are arranged to have a common axis and thus permitted to fittingly slide against the first guide hole 110E and the second guide hole 110F of the valve housing 105, respectively. Furthermore, the respective valve faces are made orthogonal to the axis of the actuation rod 101 and brought into contact with the corresponding valve seats. The actuation rod 101, however, is still prone to bending due to its large length. Also the actuation rod 101 tends to be small in diameter. The movable iron core 131 fittingly slides against the inner diameter surface of a tube 134. Moreover, the solenoid rod 101C which is connected to the movable iron core 131 also slides against the rod bore 132A of the fixed iron core 132. This significantly increases a slide friction between the movable iron core 131 and the actuation rod 101. Then the response of the movable iron core 131 and the actuation rod 101 is likely to be affected such that when the spring 121 tries to actuate the actuation rod 101 or the solenoid portion 130 is excited, the movable iron core 131 and the actuation rod 101 will fail to act quickly enough in accordance with the urging force of the spring 121 and the electric current supplied to the solenoid portion 130. This, in turn, affects the performance of the displacement control valve 100 in controlling a compressor or the like.

In order to assure a secure contact between the flat end face of the solenoid rod 101C and another flat end face of the actuation rod 101, the axis of the solenoid rod 101C and the axis of the actuation rod 101 need to be perfectly aligned with each other. High precision machining for part assembly increases its manufacture cost. The solenoid rod 101C needs to permit fluid at suction pressure P to flow into the movable iron core chamber 136 via the clearance formed between the outer diameter surface of the solenoid rod 101C and the rod bore 132A of the fixed iron core 132, while a sliding movement has to be guaranteed under the presence of clearance therebetween. Therefore, uneven wear at the end face of the solenoid rod 101C is caused by a fluctuated sliding movement of the solenoid rod 101C which will occur depending on the dimension of the clearance formed between the outer diameter surface of the solenoid rod 101C and the rod bore 132A. In particular, a hard material cannot be used for the solenoid rod 101C and unwanted wear at the end face of the solenoid rod 101C decreases a control precision of the valve body 101A against the control fluid.

Patent reference 1: Japanese Unexamined Patent Publication No, 2001-342946,A

DISCLOSURE OF THE INVENTION

Technical Problems to be Solved by the Current Invention

The present invention is made to solve the above technical problems. Primary object which the present invention tries to achieve is to decrease a slide friction of a movable core (or a movable iron core in particular) when being actuated in accordance with an electric current given to a solenoid portion by means of reducing the area of a slide surface of the movable iron core in a displacement control valve. Another object is to decrease a slide friction by keeping a solenoid rod in a non-contact state relative to a fixed core (or a fixed iron core in particular) and to simplify the installation of the fixed iron core and the sliding rod onto the fixed iron core. Yet another object is to decrease a total manufacture cost by making machining straightforward by providing a loose fit to the solenoid rod and the fixed iron core and relaxing a fit tolerance of the movable iron core sliding against the solenoid rod. Yet another object is to prevent wear of the joint end portion of the solenoid portion during its operation and to strengthen connection thereof with an actuation rod.

Solution to Solve the Technical Problems

A primary object of the present invention is to resolve the above mentioned technical problems, and a technical solution to such problems is embodied as follows.

A capacity control valve related to the present invention is comprised of a solenoid portion, a tube placed in the solenoid portion, a movable core, wherein the moveable core forms a slide surface and a non-contact surface on the outer diameter surface, wherein the slide surface is fitted to the tube, wherein the diameter of the non-contact surface is formed smaller than the diameter of the slide surface, wherein the axial length of the slide surface is formed shorter than the axial length of the non-contact surface, a solenoid rod portion, wherein the solenoid rod portion is coupled to the movable core and forms a joint surface on the free end portion of the solenoid rod portion placed opposite to the movable core, a fixed core, wherein the fixed core forms an inner bore and is placed in an opposing manner against the movable core, wherein the inner bore is loosely fitted to the solenoid rod portion, and an actuation rod, wherein the actuation rod forms an abutting face and a valve body, wherein the abutting face is engaged with said joint surface of the solenoid rod portion, wherein the valve body opens or closes a control fluid passage hole, wherein either one of the joint surface of the solenoid rod portion or the abutting face of the actuation rod is formed a concave cone-shape surface while the other is formed a convex cone-shape portion.

Advantageous Effect of the Invention

In a capacity control valve of the present invention, the slide surface formed on the outer circumference of the movable core, which undergoes a relative slide movement against the inner diameter surface of the tube formed in the solenoid portion, is arranged shorter than the axial length of a non-contact diameter surface. This provides an advantage of decreasing a slide friction of the movable core under the actuation because of a reduced sliding contact area formed between the movable core and the solenoid rod portion. Further, a slide friction of the solenoid rod portion can also be decreased as it slides because the solenoid rod is put in a non-contact state relative to the inner bore which is formed in the fixed core. The solenoid rod portion and the actuation rod portion abut against each other in such a way that abutting a concave cone surface against a convex cone surface enables a secure retainment, no fluctuation caused by the actuation rod, of the free end portion of the solenoid rod portion which is connected with the movable core. Therefore, such a contact on the slide surface of the movable core alone provides a benefit of decreasing the slide friction under a slide movement. As the convex cone-shape portion of the actuation rod abuts against the concave cone-shape portion of the solenoid rod portion, the free end portion of the solenoid rod portion is well supported under the actuation so that a friction increase during the movement of the movable core is prevented. This permits the actuation rod for its smooth operation. As its consequence, the response of the valve body in its opening and closing actions in accordance with an electric current given to the solenoid portion can improve and a high accuracy control can be achieved.

EXPLANATIONS OF REFERRAL NUMERALS

Figure 1:
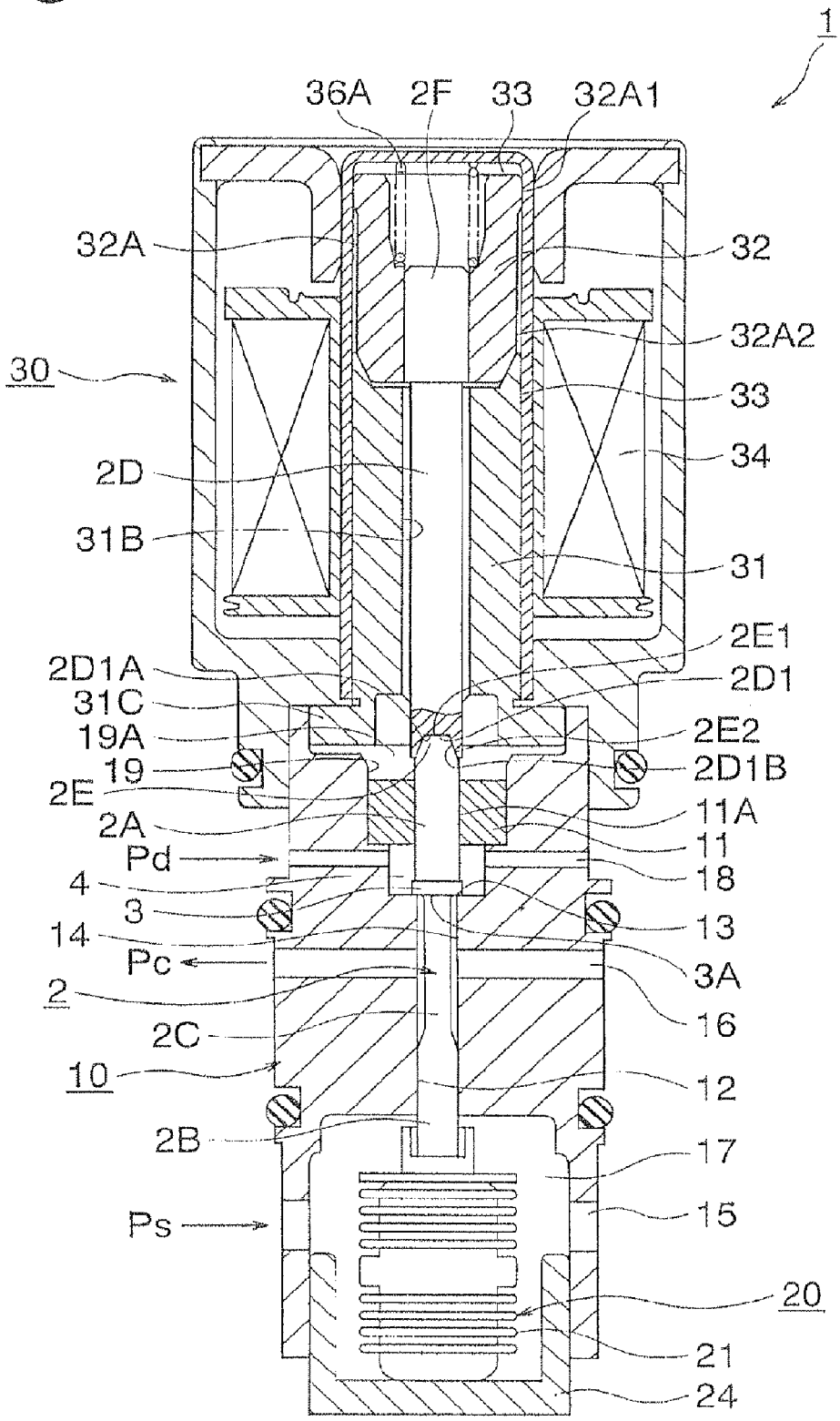
FIG. 1 shows a cross-section view of a capacity control valve as first embodiment of the present invention.

1 capacity control valve
2 Actuation rod
2A Valve body rod portion
2A1 First slide surface
2B Pressure sensing rod portion
2B1 Second slide surface
2C Connecting rod portion
2D Solenoid rod portion
2D1 Abutting face
2D1A Bottom face
2D1B Concave cone-shape surface
2E Joint portion
2E1 Truncated cone head surface
2E2 Convex cone-shape surface
2F Connecting portion
3 Valve body
3A Valve portion face
4 Valve chamber
10 Valve housing
11 Bearing
11A Guide hole
12 Slide hole
13 Valve seat
14 Control fluid passage hole
15 Third communication passage
16 Second communication passage
17 Pressure sensing chamber
17A Introduction port
18 First communication passage
19 Mount hole
19A Internal chamber
20 Pressure sensing member
21 Bellows
24 Separation adjustment portion
30 Solenoid portion
31 Fixed core (fixed iron core)
31B Inner bore
31C Flange portion
32 Movable core (movable iron core)
32A Outer diameter surface
32A1 Third slide surface
32A2 Non-contact diameter surface
33 Tube
34 Solenoid coil
36A Second spring
α Cone opening angle of the joint portion
β Cone opening angle of the abutting face
Ps Suction pressure
Pd Discharge pressure (control pressure)
Pc Control chamber pressure (crank chamber pressure)

BEST MODE FOR CARRYING OUT THE INVENTION

Described below is details of the figures of preferred embodiments of a capacity control valve constructed in accordance with the principles of the present invention. All the figures explained below are constructed according to actual design drawings.

Embodiment 1

FIG. 1 shows a capacity control valve as an embodiment relative to the present invention. Numeral 1 in FIG. 1 signifies a capacity control valve. The capacity control valve 1 has a valve housing 10 which constitutes a main body thereof. This valve housing 10 forms a through hole therewithin whose inner diameter differs in one place to the other. This valve housing 10 is made of a metal such as brass, aluminum, stainless steel or the like or a synthetic resin or the like.

The valve housing 10 forms a large bore at one end of the through hole. A separation adjustment portion 24 is securely fitted to the large bore and forms a pressure sensing chamber 17 therewithin. The outer circumferential portion at the other end of the valve housing 10 forms an outer circumferential joint portion for joining with the solenoid portion 30. Although the separation adjustment portion 24 fits the valve housing 10 at a specific location, having a screw connection permits an adjustment along the axial direction in accordance with the spring force of the pressure sensing member 20. Thus, setting of the spring force of the pressure sensing member 20 can be changed.

The through hole of the valve housing 10 forms a slide hole 12 which communicates with the pressure sensing chamber 17 and whose diameter is smaller than the diameter of the pressure sensing chamber 17. The through hole also forms a control fluid passage hole 14 communicating with the slide hole 12. Then there is disposed a valve chamber 4 which communicates with the control fluid passage hole 14 and whose diameter is larger than the diameter of the control fluid passage hole 14. Furthermore, at the other end of the through hole there is disposed a mount hole 19 which is formed in a double-step cylinder and made larger in diameter than the valve chamber 4 wherein the mount hole 19 is communicated with the valve chamber 4 and fitted to a flange portion 31C of the fixed iron core 31. A planar valve seat 13 is formed on the boundary of the valve chamber 4 and the control fluid passage hole 14. The valve seat 13 will possibly be arranged to have a tapered surface reducing its diameter in the direction of the control fluid passage hole 14. Thus, a contact area of the planer portion of the valve face 3A with the corner of the valve seat 13 can be arranged small.

The valve housing 10 disposes a first communication passage 18 which communicates with the valve chamber 4. The first communication passage 18 is arranged to communicate with a fluid passage for the fluid at control pressure Pd, e.g., discharge or control pressure Pd in case of a variable capacity compressor. Four lanes of first communication passages 18 are formed in equally spaced a manner on the circumferential surface of the valve housing 10. Arrangement of these first communication passages 18 is not necessarily four-evenly-spaced, but two three-, five-evenly-spaced or the like is possible upon necessity reasons.

Figure 5:
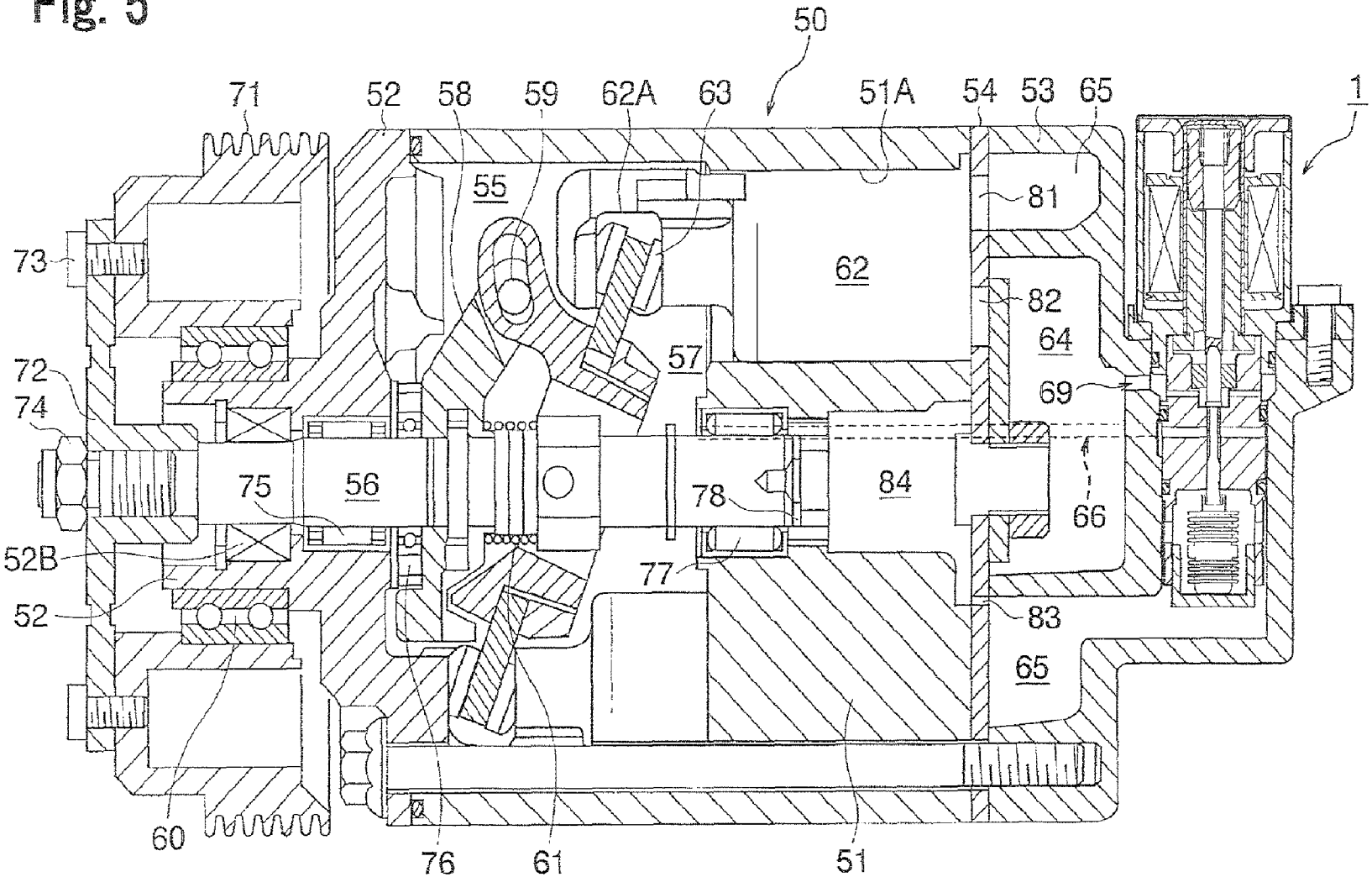
FIG. 5 A cross-section view of a variable capacity compressor and a capacity control valve related to the present invention being mounted thereto.
Figure 6:
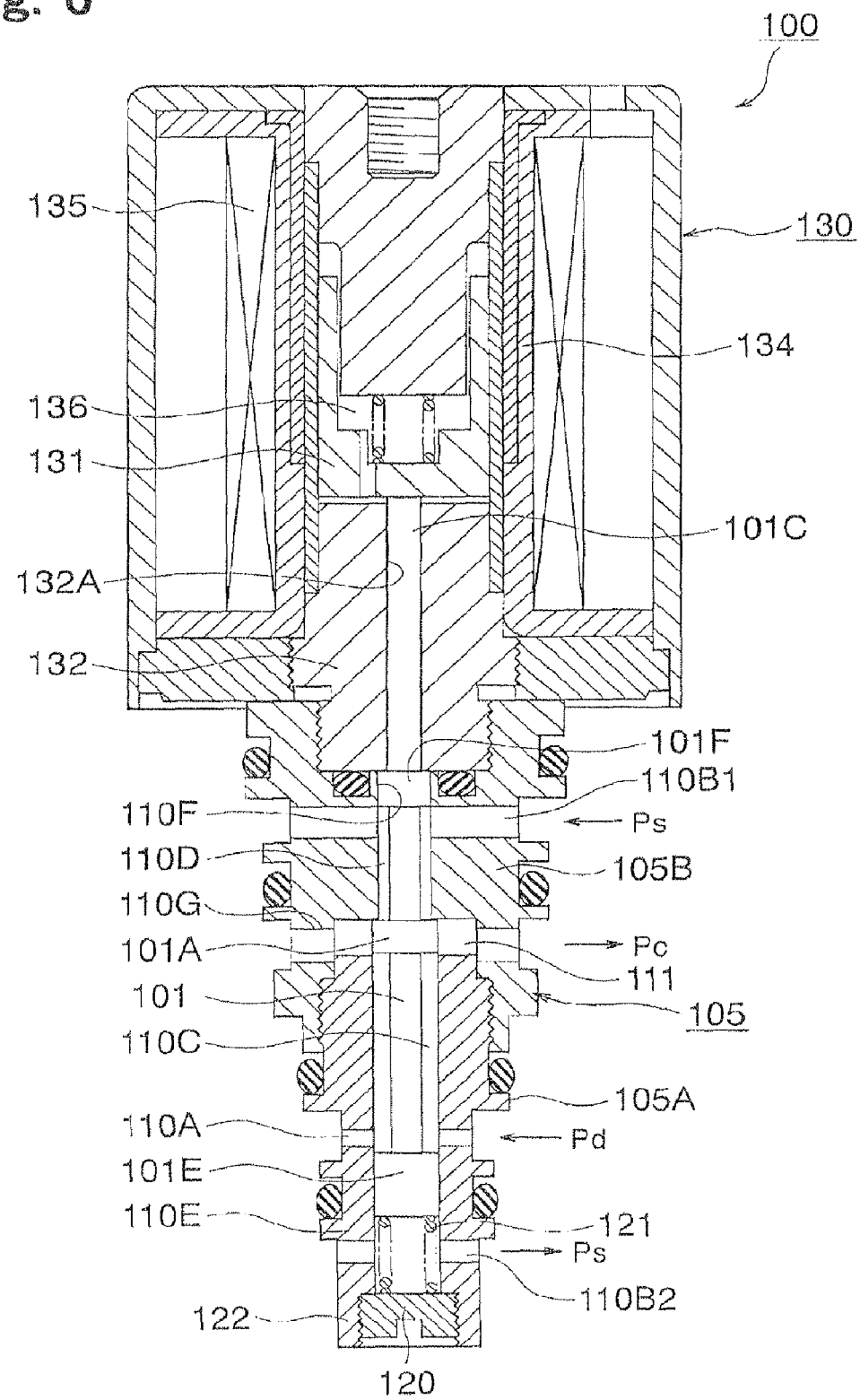
FIG. 6 A cross-section view of a control valve for a variable displacement compressor as a relative art related to the present invention.

Furthermore, the control fluid passage hole 14 disposes a second communication passage 16 for delivering incoming fluid at control pressure Pd to the control chamber, not shown (or crank chamber 55 in FIG. 5). Although four lanes of the second communication passages 16 also are formed in equally spaced a manner, two-, three-, five-evenly-spaced or the like can be chosen upon necessity, wherein each of them communicates with the control fluid passage hole 14 along the outer circumference. The valve housing 10 also forms a third communication passage 15 communicating with the pressure sensing chamber 17. The third communication passage 15 is used to introduce the fluid at suction pressure Ps from the external (compressor) into the pressure sensing chamber 17. The fluid at suction pressure Ps may contain some liquid mist such as oils or the like. The valve housing 10 disposes mount grooves for O-rings at two places of outer circumference thereof, and each mount groove mounts an O-ring thereat for providing a seal between the valve housing 10 and an installation hole of easing, not shown (or shown in FIG. 5), to which the valve housing 10 is fitted.

There is formed a pressure sensing member 20 within the pressure sensing chamber 17. The pressure sensing member 20 disposes a resiliently urging bellows 21 which is made of metal. One end of the bellows 21 is integrally connected to a mount plate. Furthermore, inside the bellows 21 there is provided a resilient first spring, not shown, and it is kept in vacuum. The bellows 21 is made of phosphorous bronze to achieve a desired spring constant. In case of an insufficient spring force, an extra spring is added to provide a sufficient urging force against the actuation rod 2.

The pressure sensing member 20 is designed in such a way that a relative force balance between the total urging force of the pressure sensing member 20 and a compressive force caused by suction pressure Ps will determine stretching and collapsing thereof. The compressive force is defined as suction pressure Ps acting on an effective pressure receiving area of the pressure sensing member 20. A large diametered portion of the mount hole 19 formed at one end of the valve housing 10 is to mount the flange portion 31C of the fixed core 31 therein. A bearing 11 is fitted to a small diametered portion of the mount hole 19. The bearing 11 disposes a guide hole 11A therein. The guide hole 11A provides the actuation rod 2 with a support for moving freely without a lateral fluctuation. Sealing films, not shown, may be placed on respective sliding surfaces of the communication holes in the valve housing 10. The sealing films are made of a material having a low friction coefficient. For example, fluoride resin film can be attached to the sliding surfaces. Use of such sheet-like films improves the operational response of the actuation rod 2.

One end portion of the actuation rod 2 is connected to a hollow part of the mount plate which is formed at one end of the pressure sensing member 20. The actuation rod 2 forms a pressure sensing rod portion 2B which slides against the slide hole 12. The actuation rod 2 also forms a connecting rod portion 2C which is integral with the pressure sensing rod portion 2B. The diameter of the connecting rod portion 2C is arranged smaller than the diameter of the control fluid passage hole 14, and this permits the fluid to be introduced from between the control fluid passage hole 14 and the connecting rod portion 2C when the valve body 3 is opening. The actuation rod 2 also forms a valve body 3 on the end portion of the connecting rod portion 2C. This valve body 3 disposes a valve face 3A which abuts against and lifts from the valve seat 13.

Figure 2:
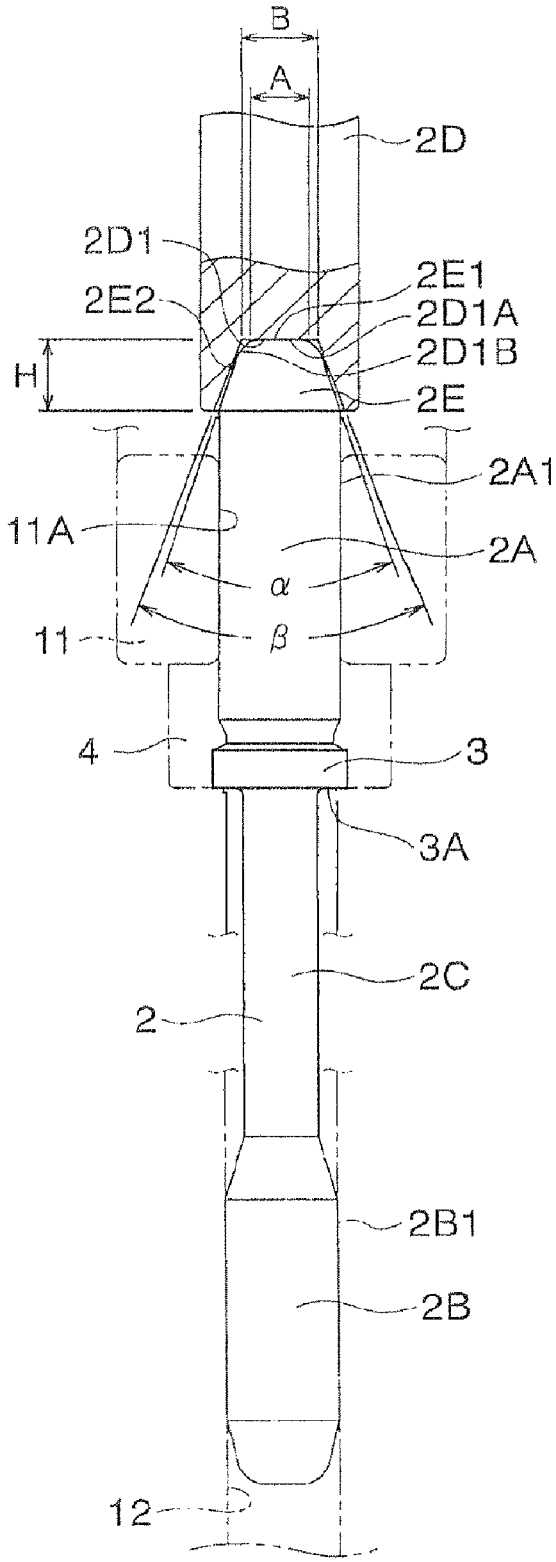
FIG. 2 A frontal view presenting a joint construction of a solenoid rod portion and an actuation rod as a second embodiment of the present invention.

The valve body 3 forms a valve body rod portion 2A whose diameter is arranged slightly larger than the diameter of the control fluid passage hole 14. FIG. 2 will simultaneously be referred to in the following descriptions. A joint portion 2E is disposed on the end portion of the valve body rod portion 2A. The joint portion 2E forms a convex cone-shape portion (also referred to as a convex cone portion) 2E2 which disposes a truncated cone head surface 2E1 at the tip. The truncated cone head surface 2E1 should not have a sharp tip end and its form should be chosen in such a way that a contact area with an abutting face 2D1 is increased, e.g., a semi-spherical surface or the like. The joint portion 2E of the valve body rod portion 2A is to be joined with the solenoid rod portion 2D via the abutting face 2D1 formed on the solenoid rod portion 2D. This actuation rod 2 is made of stainless steel while other non-magnetic materials can be used instead. The end tip portion of the joint portion 2E may have a more protruded form than the one shown in FIG. 2.

The solenoid rod portion 2D has a cylindrical form and disposes the abutting face 2D1 on one end thereof which is engaged with the joint portion 2E of the actuation rod 2. The abutting face 2D1 is constituted by a concave cone-shape surface (also referred to as a concave cone surface) 2D1B and a bottom face 2D1A which is formed at the bottom of the concave cone-shape surface 2D1B. The bottom face 2D1A of the concave cone surface 2D1B is formed so as to make a planar (or spherical or the like) contact with the truncated cone head surface 2E1 of the convex cone portion 2E2 in the actuation rod 2. A large contact area formed on the bottom face 2D1A permits an engagement with the truncated cone head surface 2E1 as a mating joint face, which decreases wear under the actuation. On the other hand, the connection portion 2F formed on the other end relative to the abutting face 2D1 is connected to a fitting bore of a movable core (also referred to as a movable iron core). The solenoid rod portion 2D is made of stainless steel.

The movable iron core 32 is formed a conical surface, facing to the fixed iron core 31. Also a cavity portion is formed in the movable iron core 32 on the opposite side of the fixed iron core 31. Further, the outer diameter surface 32A of the movable iron core 32 constitutes a sliding surface 32A1 and a non-contact diameter surface 32A2. The outer diameter D2 (refer to FIG. 3) of the non-contact diameter surface 32A2 is arranged smaller than the outer diameter D1 of the sliding surface 32A1 by 0.1 mm to 1 mm. Also the axial length L2 of the sliding surface 32A1 is formed shorter than the axial length (L1-L2) of the non-contact diameter surface 32A2. In particular, the axial length L2 of the sliding surface 32A1 should preferably not exceed one quarter of the axial length L1 of the outer diameter surface 32A. The sliding surface 32A1 of the movable iron core 32 is fitted to the inner diameter surface of a bottomed cylindrical tube 33 in freely movable a manner. Also the outer diameter of the non-contact diameter surface 32A2 is arranged not to form a contact with the inner diameter surface of the tube 33. A second spring 36A is disposed in the cavity portion which is formed on the end portion of the movable iron core 32. The second spring 36A always provides the movable iron core 32 with a resilient urging force in the direction of the valve body 3. The sliding surface 32A1 should preferably be formed on the upper end portion of the movable iron core 32 as shown in the figure.

The fixed iron core 31 is fitted to the tube 33 and opposes to the movable iron core 32 wherein the one end face of the fixed iron core 31 is formed a cone-shape cavity portion with which the cone-shape surface will engage. The fixed iron core 31 disposes a flange portion 31C to the direction of the valve body 3 where an electric current of the electromagnetic circuit formed by a solenoid coil 34 runs through. The internal of the fixed iron core 31 forms a non-contacting inner bore 31B which is arranged larger than the outer diameter of the solenoid rod portion 2D. The joint portion 21E of the actuation rod 2 and the abutting face 2D1 of the solenoid rod portion 2D will be joined within an internal chamber 19A via the valve body rod portion 2A protruding from a guide hole 11A. This allows the fluid pressure to act on the entire surrounding surface of the joint portion 2E of the valve body rod portion 2A.

Also a convex cone-shape portion 2E2 is formed on the joint portion 2E of the actuation rod 2. The end tip of the convex cone-shape portion 2E2 forms a truncated cone head surface 2E1. This truncated cone head surface 2E1 constitutes a joint planar surface. The truncated cone head surface 2E1 may alternatively be formed a semi-spherical surface and be engaged with the bottom face 2D1A which is also formed to a semi-spherical shape. On the other hand, the abutting face 2D1 of the solenoid rod portion 2D disposes a concave cone-shape surface 2D1B on the end portion. A bottom face 2D1A of the concave cone-shape surface 2D1B constitutes an abutting planar surface. The bottom face 2D1A forms a planar contact, not a point-wise contact, with the truncated cone head surface 2E1 according to a wide area, thus providing little wear and high durability thereto. The diameter A (refer to FIG. 2) of the truncated cone head surface 2E1 should preferably be arranged larger than the diameter B (refer to FIG. 2) of the bottom face 2D1A by 0.1 mm to 5 mm. Quenching can be applied to the bottom face 2D1A and the truncated cone head surface 2E1 in order to enhance hardness thereof. Also a contact between the joint portion 2E and the abutting face 2D1 can be a contact in a smaller size as long as it is not a point contact.

A solenoid coil 34 is disposed on the outer periphery of the tube 33. The solenoid portion 30 is mainly constituted by the solenoid coil 34, the movable iron core 32 and the fixed iron core 31. The opening degree of the valve body 3 is controlled by the movable iron core 32 which is actuated by the solenoid portion 30 in accordance with an electric current given to the solenoid coil 34. The opening degree of the valve body 3 is simultaneously controlled by the suction pressure Ps acting on the pressure sensing member 20. In this displacement control valve 1, the valve body 3 is opened and closed against the valve seat 13 by means of the solenoid portion 30 and the pressure sensing member 20 which are actuated according to the magnitude of the current and the suction pressure Ps, respectively, therefore adjusting the flow rate of discharge pressure Pd for being introduced to a control chamber (for example, a crank chamber 55 in FIG. 5) and modulating the pressure within the control chamber accordingly.

Embodiment 2

FIG. 2 represents a second embodiment relative to the present invention wherein an actuation rod 2 and a solenoid rod portion 2D are joined to each other. In FIG. 2, the actuation rod 2 operates in such a way that a joint portion 2E is joined to an abutting face 2D1 of the solenoid rod portion 2D. The joint portion 2E of the actuation rod 2 forms a convex cone-shape portion 2E2 wherein a truncated cone head surface 2E1 is formed on the end tip of the valve body rod portion 2A. The truncated cone head surface 2E1 is defined as an abutting planar surface which forms a circular face of diameter A. Also the abutting face 2D1 of the solenoid rod portion 2D forms a concave cone-shape surface 2D1B on end surface thereof. A bottom face 2D1A of the concave cone-shape surface 2D1B defines a joint planar surface which forms a circular face of diameter B. Depth H of the concave cone-shape surface 2D1B, for example, is chosen approximately to the same as the diameter B of the bottom face 2D1A. More preferably, the depth H should be a little smaller than the diameter B of the bottom face 2D1A. The diameter B of the bottom face 2D1A will preferably be slightly larger than the diameter A of the truncated cone head surface 2E1 by a margin of 0.1 mm to 0.4 mm. The depth H is determined according to the joint force between the actuation rod 2 and the solenoid rod portion 2D, but should preferably be smaller than the diameter B of the bottom face 2D1A. The cone angle β of the concave cone-shape surface 2D1B, unlike those shown in FIG. 1, is formed larger than the cone angle α of the convex cone-shape portion 2E2 by 0.5 to 3 degrees.

The first slide surface 2A1 of the valve body rod portion 2A undergoes a sliding movement against a guide hole 11A of a bearing 11. The second slide surface 2B1 of the pressure sensing rod portion 2B makes a sliding movement against a slide hole 12. A partially loose joint formed between the joint portion 2E of the actuation rod 2 and the abutting face 2D1 of the solenoid rod portion 2D will prevent wear due to friction on the first slide surface 2A1 and the second slide surface 2B1 because the partially formed loose joint decouples a slide movement of the actuation rod 2 thereat. Further, the frictional resistance of the actuation rod 2 under the actuation can be reduced. The actuation rod 2 is made of stainless steel. Cylindrical rod of stainless steel will be machined to form the one shown in FIG. 2.

Embodiment 3

Figure 3:
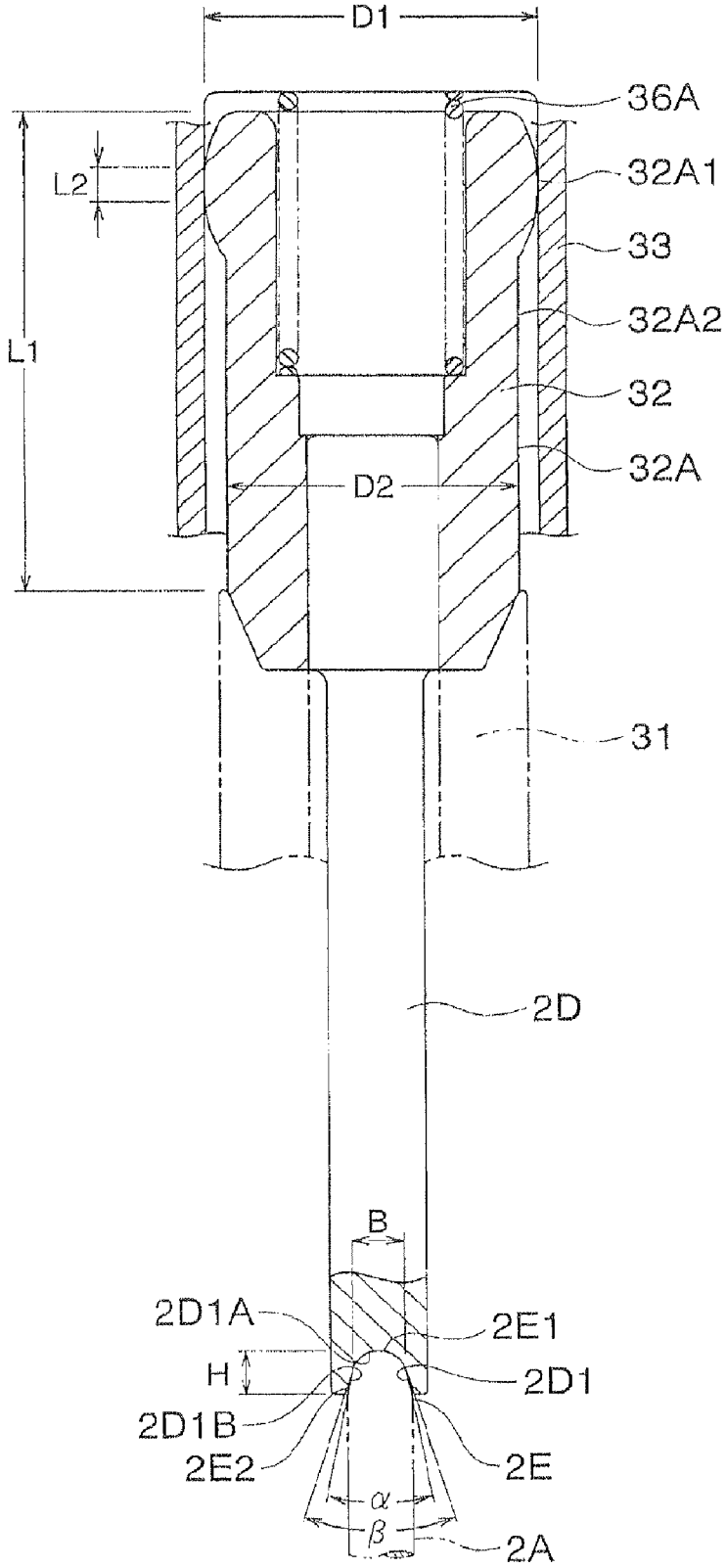
FIG. 3 A cross-section view of a movable iron core and a solenoid rod portion as a third embodiment of the present invention.

FIG. 3 shows a movable iron core 32 and a solenoid rod portion 2D of a third embodiment relative to the present invention. The movable iron core 32 is formed a cone-shape surface, facing to a fixed iron core 31. This cone-shape surface may be substituted by various kinds of surfaces which will be able to provide the same functions as the cone-shape surface does. Also a cavity portion is formed in the movable iron core 32 on the opposite side of the fixed iron core 31. Further, the outer diameter surface 32A of the movable iron core 32 constitutes a sliding surface 32A1 and a non-contact diameter surface 32A2. The outer diameter D2 of the non-contact diameter surface 32A2 is arranged smaller than the outer diameter D1 of the sliding surface 32A1 by 0.1 mm to 1.2 mm. The sliding surface 32A1 also forms a bight cross section. Although the axial length L2 of the sliding surface 32A1 is formed about one tenth of the axial length L1 of the outer diameter surface 32A, the ratio of L2 over L1 should preferably not exceed ¼.

The sliding surface 32A1 of the movable iron core 32 is fitted to the inner diameter surface of a bottomed cylindrical tube 33 in freely movable a manner. Also the outer diameter of the non-contact diameter surface 32A2 is arranged not to form a contact with the inner diameter surface of the tube 33. A second spring 36A is disposed in the cavity portion which is formed on the back end portion of the movable iron core 32. The second spring 36A always provides the movable iron core 32 with a resilient urging force in the direction of the valve body 3. An abutting face 2D1 disposed on the free end portion of the solenoid rod portion 2D is defined by a concave cone-shape surface 2D1B and a semi-spherical bottom face 2D1A being formed in a continuous manner. The depth H of the concave cone-shape surface 2D1B is set to be smaller than the diameter B of the bottom face 2D1A. Also a joint portion 2E of the actuation rod 2 is defined by a convex cone-shape portion 2E2 and a semi-spherical truncated head surface 2E1 being formed in a continuous manner. The diameter A of the truncated head surface 2E1 is approximately the same as the diameter B of the bottom face 2D1A. The diameter A of the truncated head surface 2E1 may be arranged slightly smaller than the diameter B of the bottom face 2D1A. That is, as the cone angle α of the convex cone-shape portion 2E2 is arranged smaller than the cone angle β of the concave cone-shape surface 2D1B, the truncated head surface 2E1 should rotatably move relative to the bottom face 2D1A. Other constructions will be more or less the same as those in FIG. 1.

Embodiment 4

Figure 4:
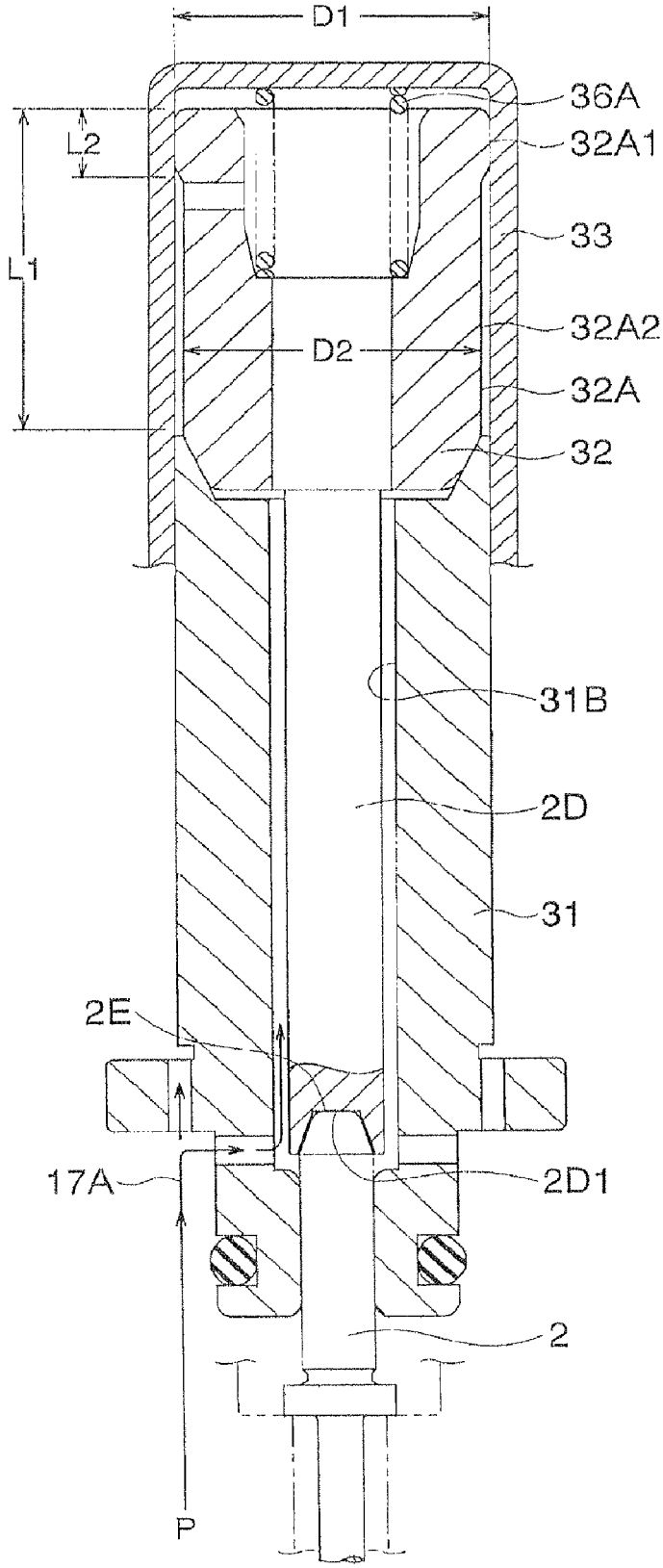
FIG. 4 A cross-section view of a tube, a fixed iron core and a movable iron core as a fourth embodiment of the present invention.

FIG. 4 shows a surrounding area of a movable iron core 32 of a capacity control valve 1 as a fourth embodiment related to the present invention. A third slide surface 32A1 of the movable iron core 32 is formed a diameter surface of length L2. Both ends of the third slide surface 32A1 then are smoothly connected to other surfaces. Also the length L2 of the third slide surface 32A1 is preferably set to about one fifth of length L1 of the outer diameter surface 32A. Further, the outer diameter of the solenoid rod portion 2D should be set small in such a way that a clearance is formed against an inner bore 31B of a fixed iron core 31. This permits the solenoid rod portion 2D to undergo a slide movement without touching the inner bore 31B. And the abutting face 2D1 of the solenoid rod portion 2D and the joint portion 2E of the actuation rod 2 are joined with each other while leaving a gap therebetween because of two different cone angles thereof while an engagement of the joint portion 2E of the actuation rod 2 with the abutting face 2D1 of the solenoid rod portion 2D prevents a fluctuation of the solenoid rod portion 2D. In addition, the actuation rod 2 is able to operate without receiving an unwanted force from the solenoid rod portion 2D. Other constructions will be more or less the same as those in FIG. 1. The joint portion 2E and the abutting face 2D1 can be arranged in pair-wise convex and concave semi-spherical forms as shown in FIG. 3.

Numeral 17A signifies an introduction port, which is a passage communicating with a pressure sensing chamber 17 (refer to FIG. 1) of a valve housing, not shown. Fluid of suction pressure Ps introduced to the pressure sensing chamber 17 is flowed from the introduction port 17A into a tube 33 which is located on the other end near the movable iron core 32. The fluid of suction pressure Ps will contain liquid such as oils or the like. Although this liquid sticks to the third slide surface 32A1, a slide friction can still be decreased because the length L2 of the third slide surface 32A1 is arranged shorter than the length L1 of the outer diameter surface 32A.

FIG. 5 shows a cross-section view of a compress mounting a capacity control valve 1 of the present invention. In FIG. 4, the compressor 50 disposes a cylinder block 51 wherein a plurality of cylinder bores 51A are formed. A front housing 52 is disposed on one end of the cylinder block 51. The cylinder block 51 also is attached to a rear housing 53 via a valve plate member 54. There is disposed a drive shaft 56 extending through a crank chamber 55 which is defined by the cylinder block 51 and the front housing 52. A awash plate 57 is disposed around the drive shaft 56 being at its center. The swash plate 57 is connected with a rotor 58 via joint members wherein the rotor 58 is fixedly connected with the drive shaft 56, and the inclination angle of the swash plate 57 can be adjusted relative to the axis of the drive shaft 56.

One end of the drive shaft 56 extends to the environment through a boss portion 52A which outwardly protrudes from the front housing 52. A screw thread is formed on the tip end portion of the drive shaft 56 and a nut member 74 is engaged with the screw thread in order to secure a drive transmission plate 72 thereat. Also a belt pulley 71 is disposed on the perimeter of the boss portion 52A via a hearing 60. The belt pulley 71 is connected to the drive transmission plate 72 by means of fixing bolts 73. Thus, a rotary motion of the belt pulley 71 implies a rotary motion of the drive shaft 56. There is disposed an oil seal 52B between the drive shaft 56 and the boss portion 52A wherein the oil seal 52B provides a seal for the interior of the front housing 52 against the environment. The other end of the drive shaft 56 is contained inside the cylinder block 51 and receives a support from a support member 78. Bearing 75, bearing 76, and bearing 77 all of which are arranged in parallel to the drive shaft 56 provide a rotatable support for the drive shaft 56.

A piston 62 is disposed in the cylinder bore 51A. A cavity 62A formed at one internal end of the piston 62 holds the peripheral portion of the awash plate 57 therewithin such that the piston 62 and the swash plate 57 have a synchronized motion via shoes 63. There are a suction chamber 65 and a discharge chamber 64, partitioned inside the rear housing 53. The cylinder bore 51 and the suction chamber 65 are communicated with each other by means of a suction port 81 disposed on the valve plate member 54 and a suction valve, not shown. The discharge chamber 64 and the cylinder bore 51A are communicated with each other by means of a discharge valve, not shown and a discharge port 82 disposed on the valve plate member 54.

The capacity control valve 1 is installed in a cavity which is formed near the back wall of the rear housing 53. The displacement control valve 1 modulates the fluid at discharge pressure Pd into the crank chamber 55 by means of adjusting the opening degrees of a fluid communication passage 69 at discharge pressure 69 as well as of a fluid communication passage 66 at crank chamber pressure Pc which connects the discharge chamber 64 with the crank chamber 55. The fluid at crank chamber pressure Pc inside the crank chamber 55 reaches the suction chamber 65 via a clearance formed between the other end of the drive shaft 56 and the bearing 77, an air chamber 84 and a fixed orifice 83. As a consequence, the capacity control valve 1 is able to control a stroke of the piston 62 in accordance with the change in crank chamber pressure Pc by means of adjusting the opening degrees of the fluid communication passage 69 for discharge pressure Pd and the fluid communication passage 66 for crank chamber pressure Pc.

Below will explain constructions and advantages of the inventions of other embodiments related to the present invention.

A capacity control valve 1 according to a second invention related to the present invention forms an abutting face 2D1 on a solenoid rod portion 2D and a joint portion 2E on an actuation rod 2, respectively, wherein a bottom face 2D1A of a concave cone-shape surface 2D1B is arranged to be a planar surface or a rather wide area with a circular cross section while a tip end portion of the other convex cone-shape portion 2E2 is formed a truncated head surface for matching the bottom face of the concave cone-shape surface 2D1B.

In the capacity control valve of the second invention, the solenoid rod portion and the actuation rod are engaged in such a way that the bottom face and the truncated head surface abut against each other by a large contact area, eliminating wear of the bottom face and the truncated head surface. Also the large contact area for the engagement of the abutting face 2D1 on the solenoid rod portion 2D and the joint portion 2E on the actuation rod 2 intensifies the connection of the engagement under the actuation.

A capacity control valve 1 according to a third invention related to the present invention is arranged such that a cone angle β of a concave cone-shape surface 2D1B is set larger than a cone angle α of a convex cone-shape portion 2E2 by 0.5 to 6 degrees.

In the capacity control valve of the third invention, the cone angle β of the concave cone-shape surface at the engagement portion of the actuation rod is arranged larger than the cone angle α of a convex cone-shape portion by 0.5 to 6 degrees. Therefore, the joint surface wherein the solenoid rod portion and the actuation rod are connected to each other is free from an urging force in an unwanted direction under the actuation of the actuation rod. This permits a smooth slide movement for the actuation rod, thus eliminating wear of the slide surface of the actuation rod. Also the concave abutting face and the convex joint portion are engaged via both cone-shape surfaces, making assembling of the movable core quite easy.

A capacity control valve 1 according to a fourth invention related to the present invention is arranged such that a concave cone-shape surface 2D1B comes into contact with a convex cone-shape portion 2E2 before the solenoid rod portion 2D makes contact with an inner bore 31B of a fixed core 31.

In the capacity control valve of the fourth invention, a concave abutting face and a convex joint portion are engaged via respective cone-shape surfaces thereof and the engagement surfaces of the concave abutting face and the convex joint portion restrict the solenoid rod portion not to touch the inner bore under a slide movement, providing an advantage of making slide friction of the movable core substantially small under a slide movement.

A capacity control valve 1 according to a fifth invention related to the present invention is arranged such that a third slide surface 32A1 is formed on the end portion of an outer diameter surface 32A of a movable core 32 and the axial length of the third slide surface 32A1 does not exceed one quarter of the total length of the outer diameter surface 32A.

In the capacity control valve of the fifth invention, the slide surface is formed on the end portion of the outer diameter surface and the axial length of the third slide surface 32A1 is not more than one quarter of the total length of the outer diameter surface, thus substantially decreasing the slide friction of the movable iron core. In particular, though some liquid material such as oils or the like contained in the fluid may be caught on the slide surface, the liquid material will soon be released because of the length of the slide surface which is set to less than one quarter of the total length of the outer diameter surface, providing an advantage for decreasing slide friction.

A capacity control valve 1 according to a sixth invention related to the present invention is arranged such that a third slide surface 32A1 has a bight-shaped cross section.

In the capacity control valve of the sixth invention, the slide surface having a bight-shaped cross section comes close to having a line contact, the slide friction being substantially decreased thereat. Further, because the total contact surface between the movable core and the solenoid rod portion is limited to nearly a line contact and the joint construction of the concave joint surface permits the concave joint surface for a free pivot motion, the slide friction of the movable iron core will substantially decrease and a precise actuation of the movable core in accordance with the electric current of the solenoid portion will become possible.

INDUSTRIAL APPLICABILITY

As described above, the capacity control valve of the present invention is effective for a pressure control of control chamber for pneumatic machine, compressor or the like. In particular, the capacity control valve has a good response under the actuation of an actuation rod and is able to eliminate wear of the abutting surfaces at an engagement construction wherein the actuation rod is connected to a solenoid rod portion.

The invention claimed is:

1. A capacity control valve comprising:

a solenoid portion;

a tube placed in said solenoid portion;

a movable core, wherein said moveable core forms a slide surface and a non-contact surface on an outer diameter surface thereof, wherein said slide surface is fitted to said tube, wherein a diameter of said non-contact surface is formed smaller than a diameter of said slide surface, wherein an axial length of said slide surface is shorter than an axial length of said non-contact surface;

a solenoid rod portion coupled to said movable core and which forms an abutting surface on a free end portion of said solenoid rod portion placed opposite to said movable core;

a fixed core which defines an inner bore and is placed in an opposing manner against said movable core, the inner bore loosely fitted to said solenoid rod portion; and an actuation rod having a joint portion and a valve body, the joint portion being engaged with said abutting surface of said solenoid rod portion, the valve body opening or closing a control fluid passage hole;

wherein one of said abutting surface of said solenoid rod portion and said joint portion of said actuation rod has a concave cone-shape surface while the other has a convex cone-shape portion; and wherein the slide surface is formed to have a bight cross section, and wherein a cone angle $\beta$ of said concave cone-shape surface of said solenoid rod portion is formed larger than a cone angle $\alpha$ of said convex cone-shape portion of said actuation rod by 0.5 to 6 degrees.

2. A capacity control valve according to claim 1, wherein a bottom face of said concave cone-shape surface is formed as a wide area of either a planar surface or a circular cross section, and wherein a head portion of said convex cone-shape portion is truncated to form a truncated cone surface, the truncated cone surface corresponding to the bottom face of said concave cone-shape surface.

3. A capacity control valve according to claim 1, wherein the slide surface is placed on the end portion of said outer diameter surface of said movable core and the axial length of the slide surface is not more than one quarter of the total length of the outer diameter surface.

* * * * *